US007044034B2

(12) United States Patent
Hsien

(10) Patent No.: US 7,044,034 B2
(45) Date of Patent: May 16, 2006

(54) SLIDE STOP DEVICE OF A HEXAGONAL SPANNER

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/858,428

(22) Filed: Jun. 2, 2004

(65) Prior Publication Data

US 2005/0268755 A1 Dec. 8, 2005

(51) Int. Cl.
*B25B 23/08* (2006.01)

(52) U.S. Cl. ..... 81/452; 81/436

(58) Field of Classification Search ..... 81/436, 81/452, 447, 442, 13
See application file for complete search history.

(56) References Cited

U.S. PATENT DOCUMENTS

| | | | | |
|---|---|---|---|---|
| 544,606 | A * | 8/1895 | Balsley | 81/444 |
| 1,043,146 | A * | 11/1912 | Schiess | 403/290 |
| 1,245,754 | A * | 11/1917 | Matteson | 81/437 |
| 6,393,953 | B1 * | 5/2002 | Totsu | 81/452 |
| 6,681,662 | B1 * | 1/2004 | Blackston | 81/451 |
| 6,808,182 | B1 * | 10/2004 | Lin | 279/74 |
| 2004/0031360 | A1 * | 2/2004 | Her | 81/436 |

FOREIGN PATENT DOCUMENTS

| | | | |
|---|---|---|---|
| DE | 3123112 | A1 * | 12/1982 |
| GB | 2050899 | A * | 1/1981 |
| GB | 2050900 | A * | 1/1981 |

* cited by examiner

*Primary Examiner*—David B. Thomas

(57) ABSTRACT

A slide stop device of a hexagonal spanner serves for preventing a rounded edged inner hexagonal screw to slide as the hexagonal spanner drives the inner hexagonal screw. The slide stop device comprises a spanner body; one end of the spanner body having a driving portion; the driving portion having an axial slot extending through a center of one end surface of the driving portion to a lateral side thereof; a screw hole to be normal to one inner surface of the slot; a screwing resisting element having a shape matching the shape of the screw hole; the screwing resisting element serves for enforcing the driving portion to deform. In use, the screwing resisting element is inserted into the screw hole. When the screwing resisting element is inserted to push one surface of the slot, the slot will be expanded so as to expand the driving portion.

6 Claims, 6 Drawing Sheets

SLIDE STOP DEVICE OF A HEXAGONAL SPANNER

FIELD OF THE INVENTION

The present invention relates to spanners for driving hexagonal screws, and particular to a slide stop device of a hexagonal spanner.

BACKGROUND OF THE INVENTION

In general, if a screw is used for a longer time, the screw will round so that it is difficult to drive the screw by a spanner. Thereby, it is often that the screw must be destroyed for taking the screw out. This will destroy the work piece.

Thereby, to improve the defect in the prior art, there are some ways are developed for resolving the prior art problem.

However, all these improvements are aimed to improve outer hexagonal screws (that is, a screw has a hexagonal driving portion at an outer side of the screw) instead of improving inner hexagonal screws (that is, a screw has a hexagonal driving portion at an inner side of the screw).

This is because, referring to FIG. 9, the conventional spanner for driving an inner hexagonal screw has a solid structure which does not deform. Each spanner is designed for screws with predetermined sizes. As the inner hexagonal screw has rounded edges so that as the hexagonal screw is driven, it will slide with respect to the spanner so that it can not be effectively driven.

However, for the outer hexagonal screws, the conventional spanner has expandable laming portions at two ends thereof so that as the edges of the hexagonal portion of an outer hexagonal screw are rounded, the clamping portions can deform to match the round edges of the outer hexagonal screws, but no this mechanism is design for the convention spanner for driving the inner hexagonal screws.

SUMMARY OF THE INVENTION

Accordingly, the primary object of the present invention is to provide a slide stop device of a hexagonal spanner for preventing a rounded edged inner hexagonal screw to slide as the hexagonal spanner drives the inner hexagonal screw. The slide stop device comprises a spanner body; one end of the spanner body having a driving portion; the driving portion having an axial slot extending through a center of one end surface of the driving portion to a lateral side thereof; a screw hole to be normal to one inner surface of the slot; a screwing resisting element having a shape matching the shape of the screw hole; the screwing resisting element serves for enforcing the driving portion to deform. In use, the screwing resisting element is inserted into the screw hole. When the screwing resisting element is inserted to push one surface of the slot, slot will be expanded so as to expand the driving portion.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
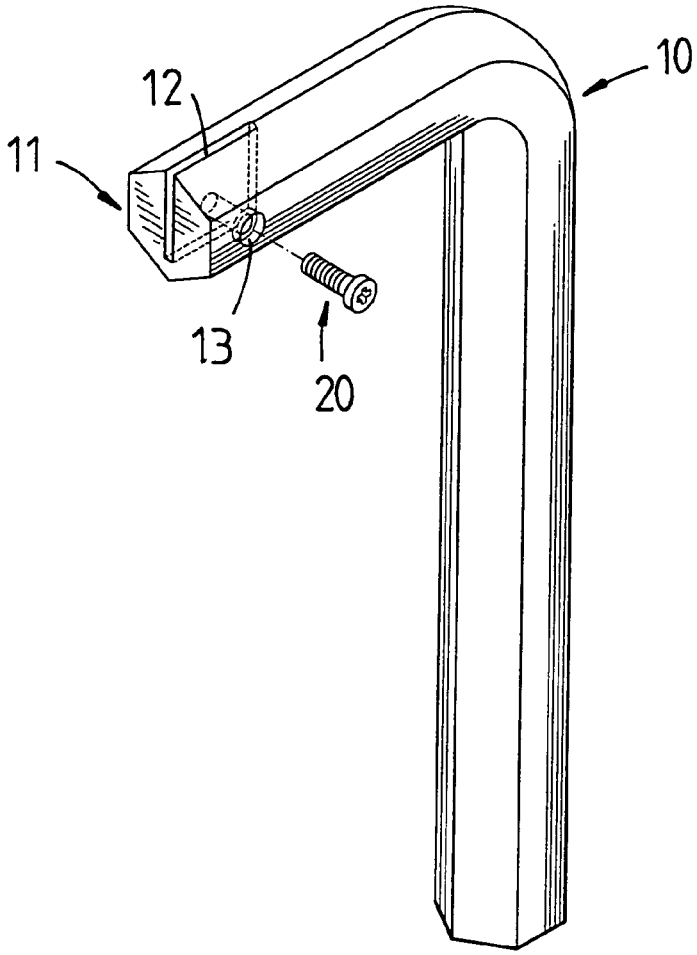
FIG. 1 is an exploded perspective view of a first embodiment of the slide stop device of a hexagonal spanner of the present invention.
Figure 2:
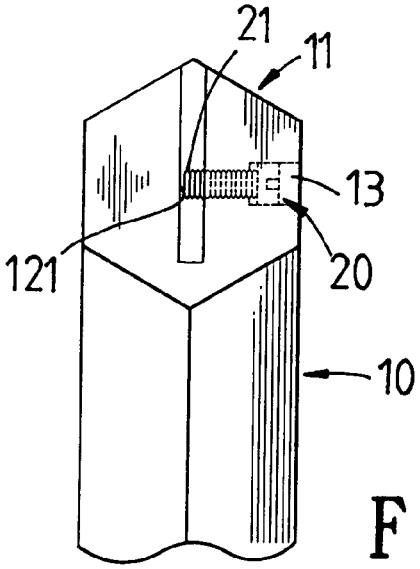
FIG. 2 shows a cross section view of the slide stop device of a hexagonal spanner of the present invention.

With reference to FIGS. 1 and 2, the slide stop device of a hexagonal spanner of the present invention is illustrated. The slide stop device of a hexagonal spanner includes the following elements.

A spanner body 10 is enclosed. One end of the spanner body 10 has a driving portion 11. The driving portion 11 has one axial slot 12. The slot extends through a center of one end surface of the driving portion 11 to a lateral side of the driving portion 11, preferably, to one apex of a cross section of the driving portion 11. A screw hole 13 is formed to be normal to one surface of the slot so as to communicate the slot and the external space out of the spanner body 10.

A screwing resisting element 20 has a shape matching the shape of the screw hole 13. The screwing resisting element 20 serves for enforcing the driving portion 11 to deform. The screwing resisting element 20 has a resisting end 21.

In the present invention, the screwing resisting element 20 and the screw hole 13 can be threaded for being engaged to one another.

In the hexagonal spanner of the present invention, a screw hole 13 is formed. By this space, the hexagonal spanner can deform from this portion so as to screw a loosely engaged inner hexagonal screw.

Figure 4:
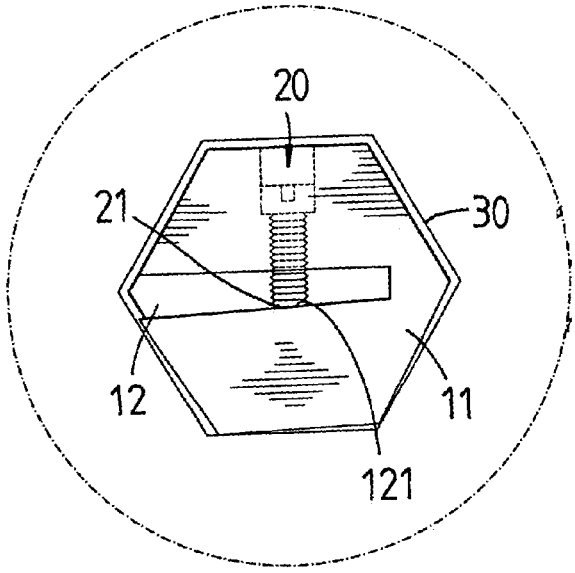
FIG. 4 shows a further application of the slide stop device of a hexagonal spanner of the present invention.
Figure 3:
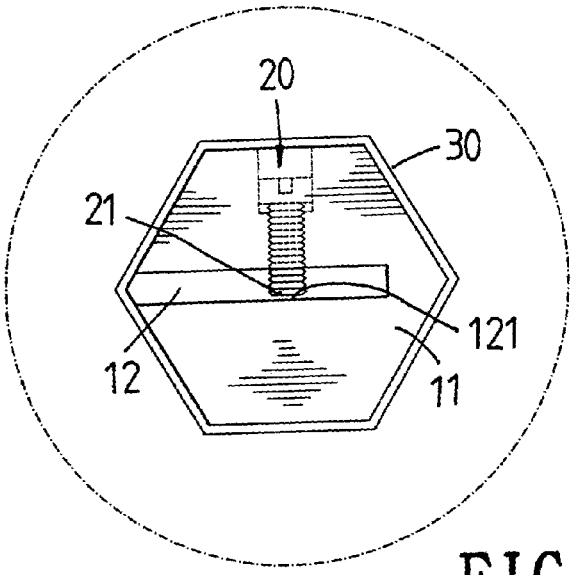
FIG. 3 shows one application of the slide stop device of a hexagonal spanner of the present invention.

In use, referring to FIGS. 3 and 4, the screwing resisting element 20 resists against one resisting surface 121 of the slot 12. The driving portion 11 of the spanner body 10 is inserted into an inner hexagonal screw 30 for driving the hexagonal screw 30 to rotate. If the inner hexagonal screw 30 is rounded at sides so that when driving the inner hexagonal screw 30, the spanner body 10 will slide and thus the hexagonal screw 30 can not be driven effectively. Then, the screwing resisting element 20 can be pushed inwards so as to expand the slot 12. As a result, the driving portion 11 is expanded. Thus, the outer walls of the driving portion 11 will resist against the inner wall of the inner hexagonal screw 30.

Figure 5:
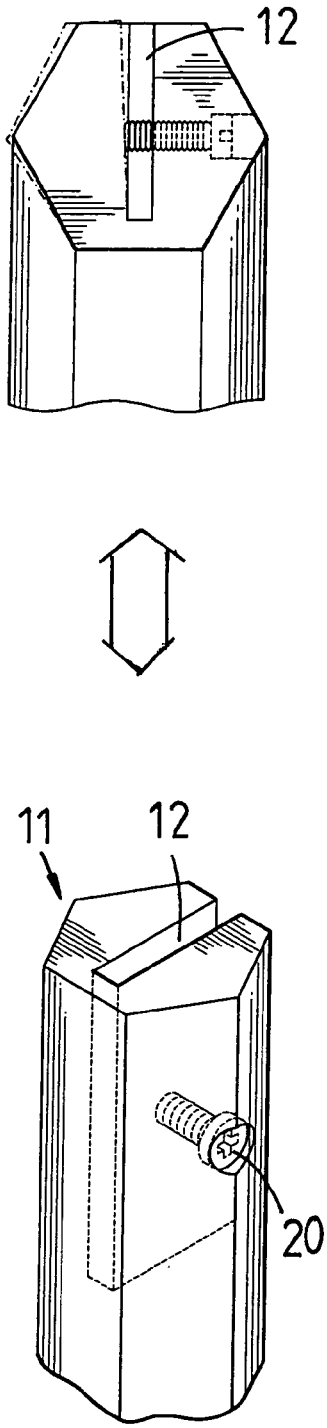
FIG. 5 shows the second embodiment of the slide stop device of a hexagonal spanner of the present invention.
Figure 6:
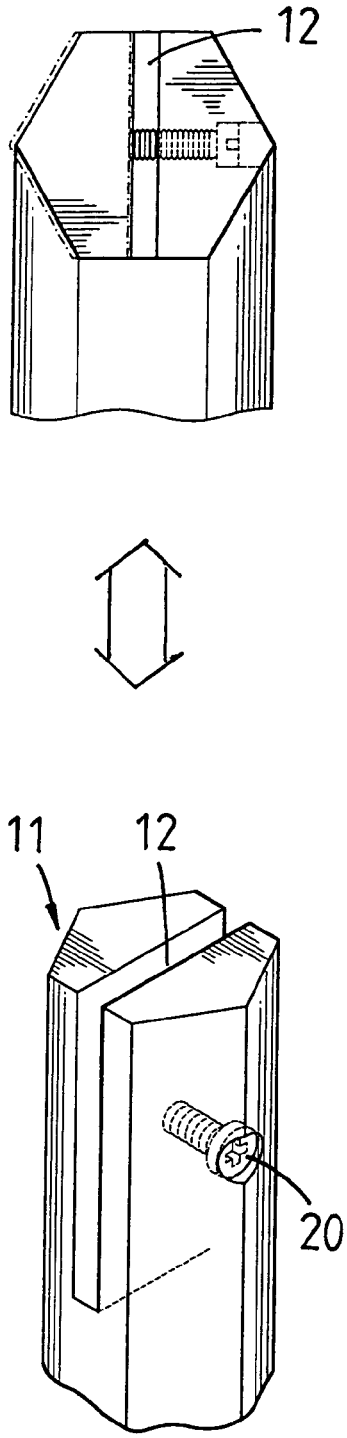
FIG. 6 shows the third embodiment of slide stop device of a hexagonal spanner of the present invention.

In FIGS. 1 and 2, it is illustrated that the screw hole 13 passes through the apex of a hexagonal cross section of the driving portion 11. With reference to FIG. 5, it is illustrated that the screw hole 13 passes through a lateral side of the hexagonal cross section of the driving portion 11 between two apexes of the hexagonal cross section. In FIG. 6, it is illustrated that the screw hole 13 penetrates through two sides of the hexagonal cross section of the driving portion 11.

Figure 7:
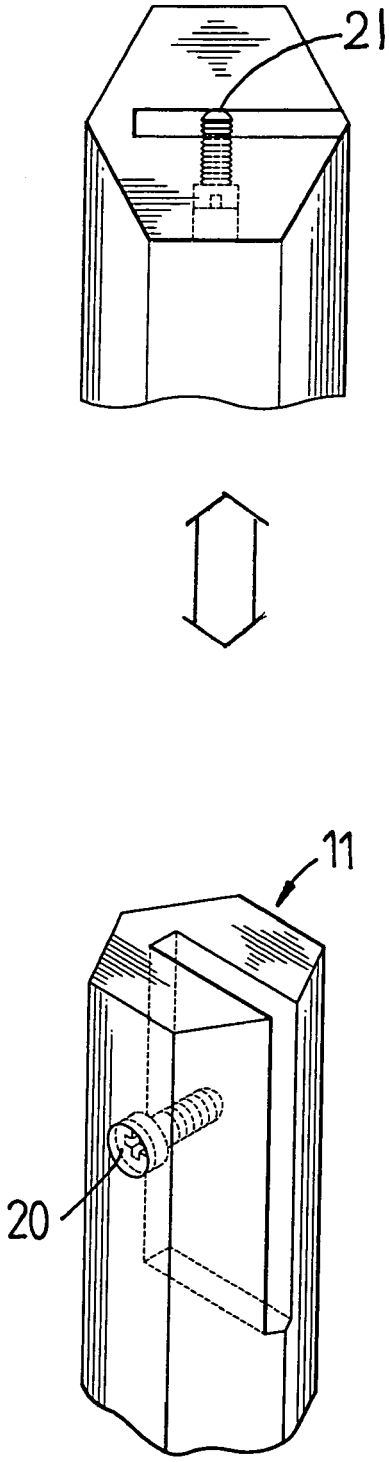
FIG. 7 shows the fourth embodiment of the slide stop device of a hexagonal spanner of the present invention.
Figure 8:
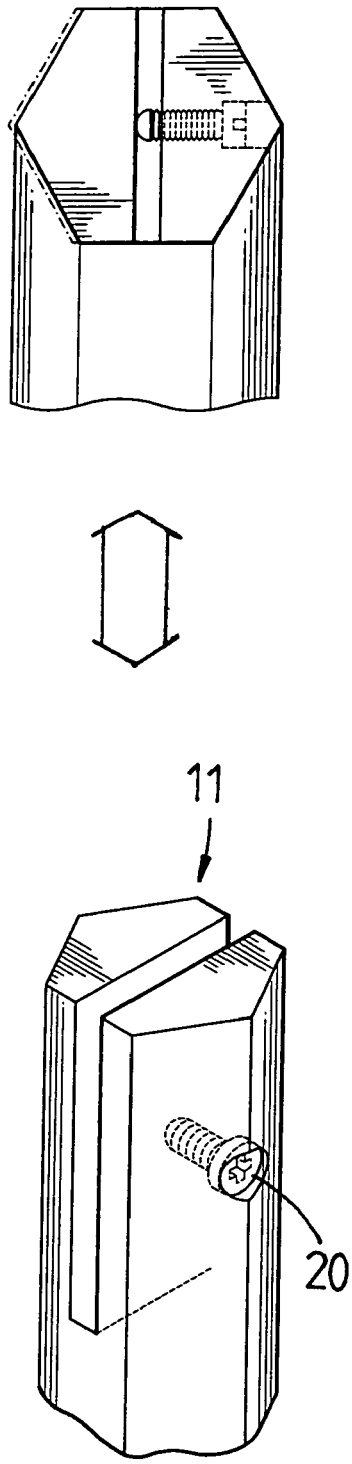
FIG. 8 shows the fifth embodiment of the slide stop device of a hexagonal spanner of the present invention.
Figure 9:
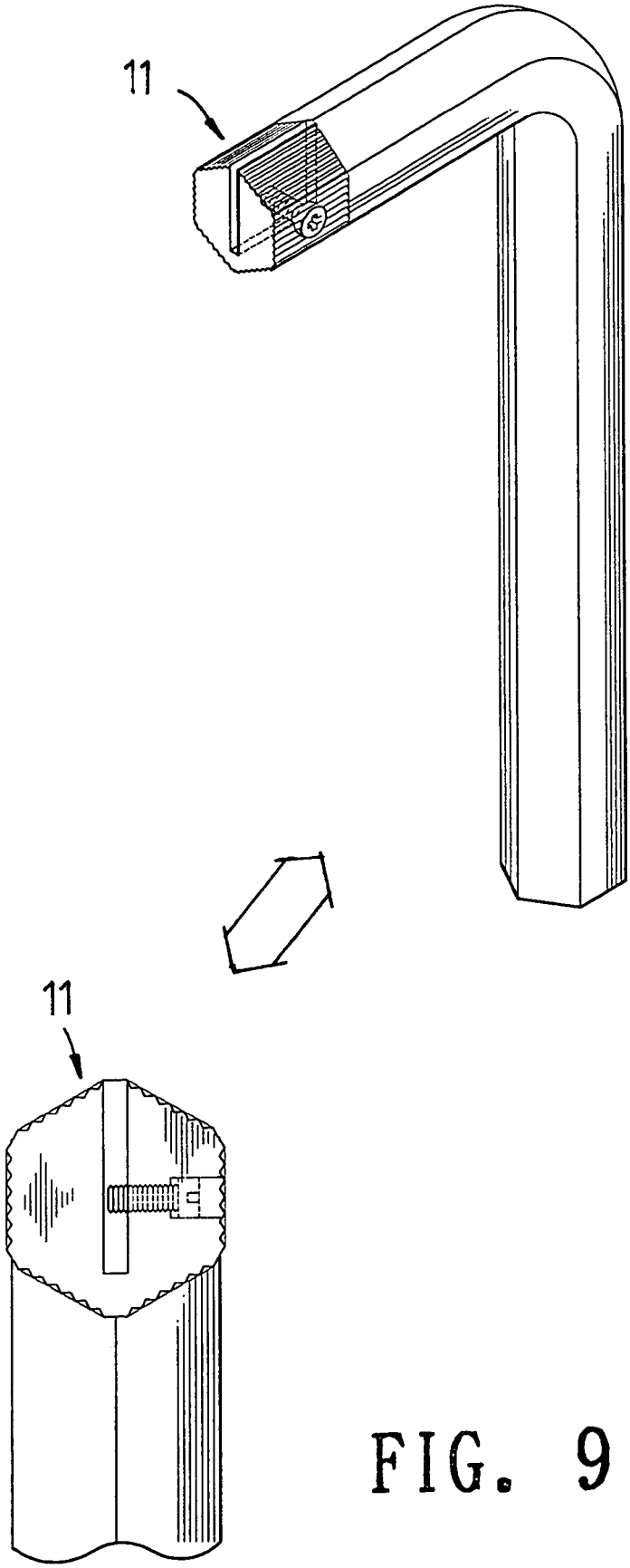
FIG. 9 shows a sixth embodiment of the slide stop device of a hexagonal spanner of the present invention.
Figure 10:
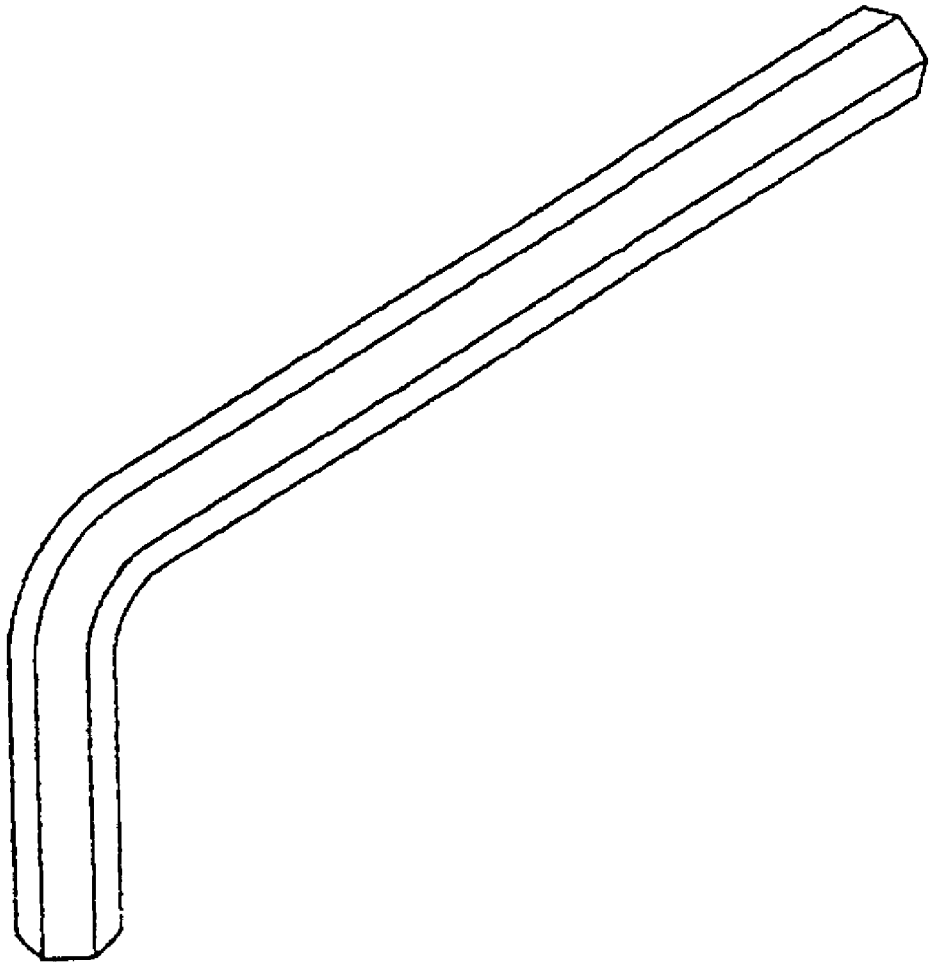
FIG. 10 PRIOR ART
FIG. 10 shows a perspective view of a perspective view hexagonal spanner.

With reference to FIGS. 7 and 8, it is illustrated that a resisting end at a front end of the screwing resisting element 20 is a rounded end so as not to destroy the resisting surface 21 of the slot 12. With reference to FIG. 9, the fifth embodiment of the present invention is illustrated. The outer wall of the driving portion 11 are teethed, or waved (not shown), or textured (not shown), or formed with regular or irregular shapes (not shown) so as to increase the friction force in rotation.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A slide stop device of a hexagonal spanner for preventing a rounded edged inner hexagonal screw to slide as the hexagonal spanner drives the inner hexagonal screw; the slide stop device comprising:

a spanner body; one end of the spanner body having a hexagonal driving portion; the driving portion 11 having an axial slot extending through a center of one end surface of the driving portion to a lateral side of the driving portion;

a screw hole to be normal to one inner surface of the slot so as to communicate the slot and an external space out of the spanner body;

a screwing resisting element having a shape matching the shape of the screw hole; the screwing resisting element serving for enforcing the driving portion to deform; a length of screw resisting element being shorter than a length of the depth of the hole;

wherein in use, the screwing resisting element is inserted into the screw hole until the screwing resisting element is wholly embedded into the screw hole; when the screwing resisting element is inserted to push one surface of the slot, the slot will be expanded with one side of the slot has a fixed length equally to an original size without expansion so as to expand the driving portion; and wherein the screwing resisting element and the screw hole are threaded for engaging to one another.

2. The slide stop device of a hexagonal spanner as claimed in claim 1, wherein each slot is ended at one apex of a hexagonal cross section of the driving portion.

3. The slide stop device of a hexagonal spanner as claimed in claim 1, wherein each slot is ended to one side of a hexagonal cross section of the driving portion between two apexes of the hexagonal cross section of the driving portion.

4. The slide stop device of a hexagonal spanner as claimed in claim 1, wherein the screwing resisting element has a round resisting end at one end thereof.

5. The slide stop device of a hexagonal spanner as claimed in claim 1, wherein an outer wall of the driving portion are teethed, or waved, or textured, or formed with regular or irregular shapes so as to increase the friction force in rotation.

6. The slide stop device of a hexagonal spanner as claimed in claim 1, wherein the axial slot penetrates through two sides of the hexagonal cross section of the driving portion.

* * * * *